US005100021A

United States Patent [19]

Mussi et al.

[11] Patent Number: 5,100,021

[45] Date of Patent: Mar. 31, 1992

[54] PIPETTE DISPENSER PACKAGE

[75] Inventors: Edward F. Mussi, Hewitt; Martin H. Golden, Highland Park, both of N.J.

[73] Assignee: Becton, Dickinson and Company, Franklin Lakes, N.J.

[21] Appl. No.: 244,438

[22] Filed: Sep. 14, 1988

[51] Int. Cl.[5] ..... B65D 83/02

[52] U.S. Cl. ..... 221/155; 221/288; 221/302

[58] Field of Search ..... 221/186, 188, 189, 288, 221/302, 155; 222/454, 455, 456

[56] References Cited

U.S. PATENT DOCUMENTS 1,182,920 5/1916 Martin et al. ..... 221/189
2,362,609 11/1944 Blackman ..... 221/288
2,435,782 2/1948 Higgins ..... 221/189 X

FOREIGN PATENT DOCUMENTS 8606350 11/1986 World Int. Prop. O. ..... 221/302

*Primary Examiner*—F. J. Bartuska
*Attorney, Agent, or Firm*—Robert P. Grindle

[57] ABSTRACT

A combined dispenser tray and package is provided for pipettes. The tray is elongated with a stepped front wall which provides a dispensing position for sequentially dispensing individual pipettes, as required. The front wall includes a built-in curved wall portion for feeding the individual pipettes, one at a time, to the dispensing position for removal. A cooperating cover is provided with a hinged peel tab for gaining access to the dispensing position. A further feature of the tray of the invention is that the stepped configuration, as seen in cross-section, allows for stacking a plurality of trays in a compact fashion for shipping and storage.

8 Claims, 2 Drawing Sheets

PIPETTE DISPENSER PACKAGE

BACKGROUND AND STATEMENT OF THE INVENTION

This invention relates to a dispenser tray for pipettes. More particularly, this invention relates to such a dispenser tray or package which is configured to dispense in a sequential fashion individual pipettes, one at a time. The arrangement is such that the remaining pipettes in the tray or package are maintained in a sterile condition and the tray is recloseable so that, the possibility of contamination is reduced during storing of the tray.

As will be appreciated by practitioners in the art, pipettes are used in great numbers in a clinical laboratory, for example. These pipettes are used once and then discarded so that no contamination takes place from one pipette use to another. Because of the great quantity used during a work day in a clinical lab, for example, it is important to have a plurality of pipettes available for dispensing for immediate and convenient use.

In the past, arrangements have been provided for packages of multiple pipettes of, perhaps, twenty-five or even one hundred pipettes. They may be contained in a bag such as a thermoplastic bag which is in the form of a dispenser pack with pre-wrapped pipettes. Such packaging of individual pipettes is extremely expensive, considering the great quantities used during a period of time. Other packaging used in the prior art includes a dispenser pack in which a carton is utilized with a punch out arrangement at the end of the box for dispensing. With such an arrangement, as will be understood by practitioners in the art, the users simply thrust fingers into the open punched out end of the carton to grasp an individual pipette. With such an arrangement, as will be understood, contamination of the remaining pipettes may take place under such a dispensing approach. If the individual pipettes are, again, individually wrapped to maintain them sterile in the package, the cost becomes prohibitive.

With this invention, by contrast, a dispenser tray is provided for a plurality of pipettes which dispenser tray has a peelable lid portion. The tray is configured to have a stepped front end wall which defines a dispensing position for sequentially dispensing individual pipettes. The front wall has, in addition, insert portions which on the internal surface thereof provide a curved surface for feeding the individual pipettes to the dispensing position.

The arrangement is such that the device may be simply tilted to allow the user, by looking through the transparent wall of the package, to feed an individual pipette to the dispensing position, peel off the portion of the resealable lid which allows access to the dispensing position, remove the individual pipette in that position and reclose the package. Thus, the package remains generally sterile and the individual pipettes remain contained in the tray until such time as they are required. By having such an arrangement, the individual pipettes do not need to be packaged separately, thus reducing substantially the cost of the purchase of a batch of pipettes of say twenty-five per individual tray. Of course, it will be understood, that the trays may be larger or smaller to accommodate differing quantities and that the dispenser tray of the invention may have as many as one hundred pipettes contained therein for dispensing to the lab technician, for example.

Other objects and advantages of this invention will be apparent from the following description, the accompanying drawings and the appended claims.

DETAILED DESCRIPTION OF THE INVENTION

Figure 1:
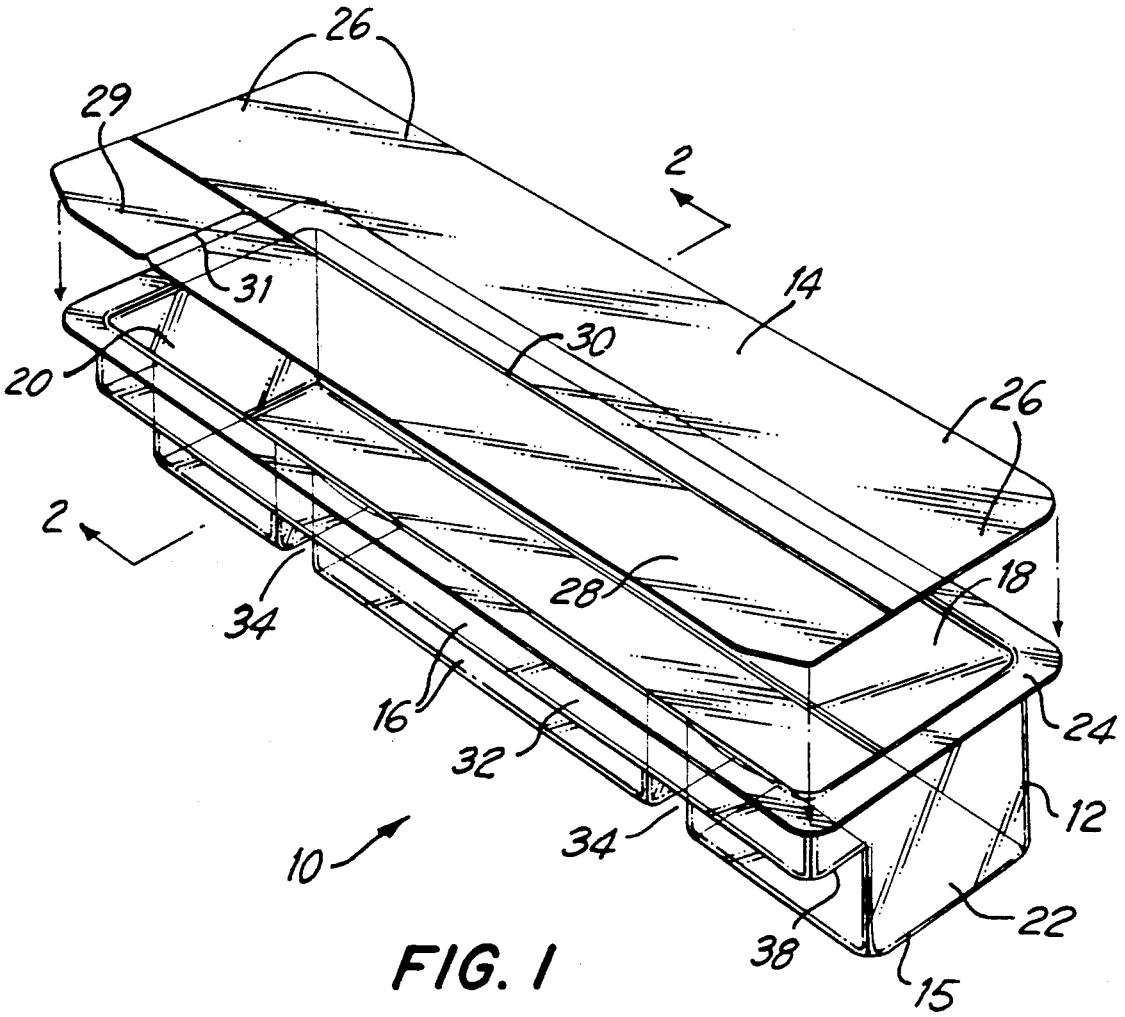
FIG. 1 is an exploded perspective view of the dispenser tray of the invention, with the lid for the tray shown separately from the tray itself to indicate in more detail the cooperating surfaces for the tray and its lid.
Figure 2:
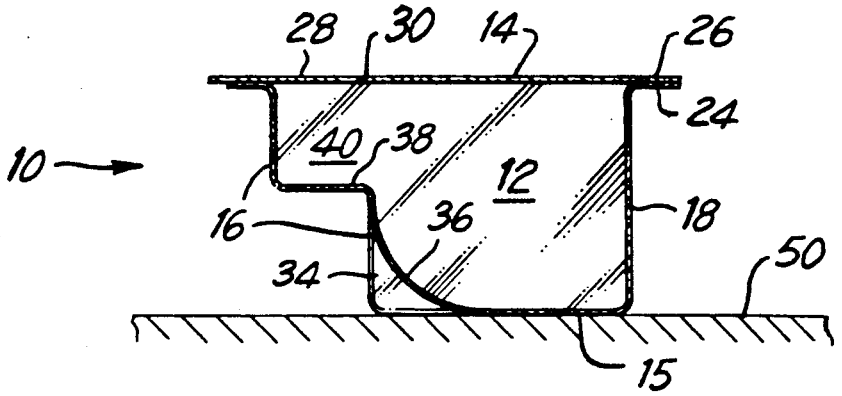
FIG. 2 is a sectional view taken along lines 2—2 of FIG. 1.

Referring to the drawings in which like reference characters refer to like parts throughout the several views thereof, FIG. 1 illustrates the invention in the form of an elongated dispenser tray assembly 10 comprised of a clear material with the top 14 therefor shown spaced from the tray 12 itself to indicate the cooperating surfaces of the top and the tray. Thus, tray 12 has a front wall 16 and a rear wall 18 and end walls 20, 22. As can be seen in FIG. 1, front wall 16 is stepped to provide an overhang platform 38, which provides, as shown in FIG. 2 a dispensing position 40 for the individual pipettes. Also as can be seen in FIG. 1, front wall 16 includes two spaced apart insert areas 34 which, in section, again as shown in FIG. 2, provide a curved surface 36 for feeding individual pipettes from the base wall 15 along the curved surface 36 to the platform 38 at the dispensing position 40.

As can be seen in FIG. 1, lid 14 has an edge surface 26 while tray 14 has on the upper edge of its four walls an edge surface 24. The opposed surfaces 24, 26 are sealed together to provide the dispensing package or tray of the invention. The lid 14 includes a peel tab 28, which folds back along line 30, so that the dispensing area 40 is accessible for receiving or obtaining an individual pipette positioned on platform 38. Preferably, tab 28 separates at 31, leaving a fixed portion 29, which covers the pipette tips at all times.

Figure 3:
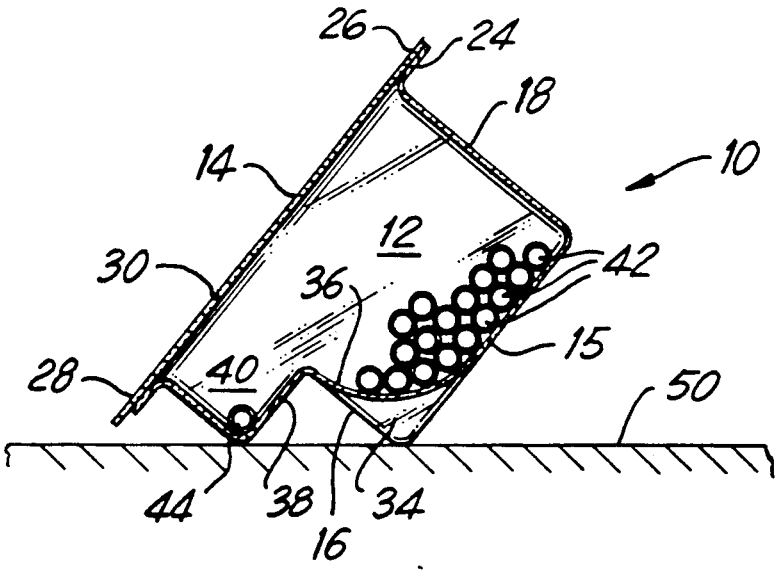
FIG. 3 is another sectional view of the tray shown in FIG. 2 in a dispensing position.
Figure 4:
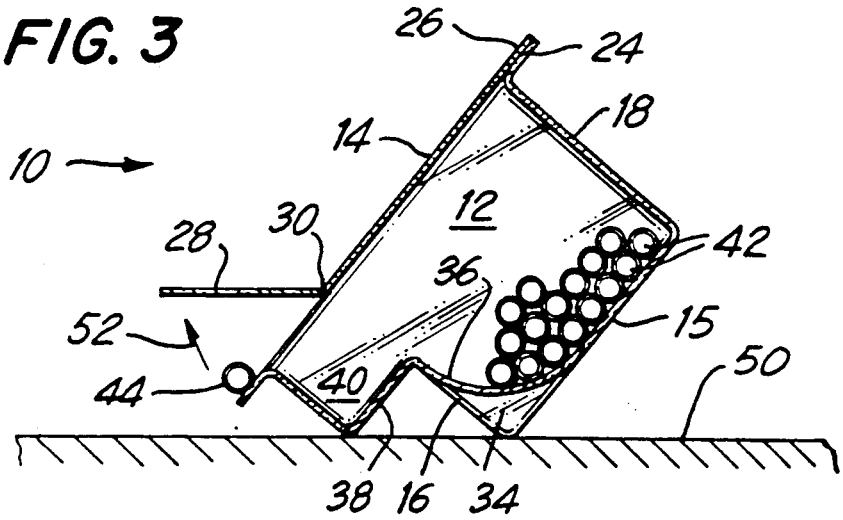
FIG. 4 is an additional sectional view showing a further sequence of the dispensing operation of the tray of the invention with the peel back lid open for access to an individual pipette.

Referring now to FIG. 2, a sectional view of the tray assembly 10 is shown. When a plurality of pipettes 42 are placed in the container tray or package 10 of the invention, they will assume the position generally shown in FIG. 3. When a lab technician requires one pipette, such as 44 shown in FIG. 3, he or she may tilt the tray assembly 10 to the position shown in FIG. 3 on a surface 50, and leave it there or tilt it back as desired. The tilting action causes one pipette 44 to roll along surface 36 to platform area 38. At this point, and referring to FIG. 4, the user may then pull open peel tab 28 to gain access to pipette 44. The peel tab moves in the direction of arrow 52 as shown in FIG. 4, for gaining access to the dispensing area 40 as shown in FIG. 4.

Once the pipette 44 is obtained, the peel tab 28 may be closed and resealed in order to maintain the remaining pipettes 42 sterile until it is desired to obtain an additional one. The user may then tilt the tray and/or package assembly again in order to cause one pipette to roll along surface 36 to platform area 38 for removal of the individual pipette when peel tab 28 is again opened for that purpose.

Figure 5:
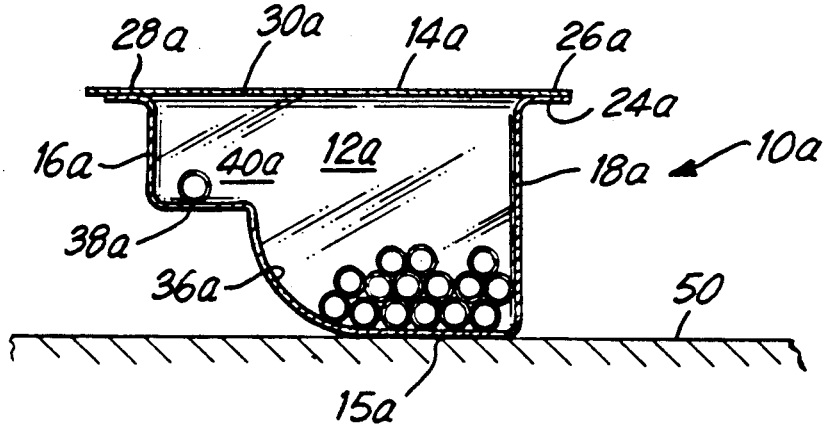
FIG. 5 is a sectional view similar to FIG. 2 showing another embodiment of dispenser tray of the invention.

In the embodiment of FIG. 5, all of the same parts are designated with the same reference number with the addition of the letter "a". As can be seen on FIG. 5, the lower portion of front wall 16*a* is modified to form that portion as curved wall 36*a*. The lower portion of front wall 16*a* below platform 38*a* is removed.

While the tray assembly of the invention may be comprised of many materials, it is preferred that it will be comprised of a clear thermoplastic material which may be thermoformed into the desired shape, such as polyethylene or polypropylene, for example. Preferably, tray body 12 itself will be formed separately from lid 14. However, it is within the purview of this invention that the entire assembly 10 can be formed simultaneously. While it is not necessary, preferably, the tray assembly of the invention will be comprised of a transparent material so that the user may easily recognize the positioning of the pipettes for dispensing within the container prior to opening the peel back lid. Also, it will be understood that the mating surfaces for the peel back lid may include a representative adhesive or some substitute such as a tape which will allow adherence of the two mating surfaces 24, 26 while still allowing for separation to gain access to the dispensing position of the dispenser tray of the invention. Alternatively, a cooperative force fit arrangement may be provided.

Whereas, as discussed above, a specific embodiment of a dispenser tray of the invention has been shown, it is to be understood that it is within the purview of this invention to provide variations in the shape and/or form of the tray. For example, the stepped front wall may have a different configuration in order to provide the feeding property for the individual pipettes in order for them to gain access to the platform area for dispensing an individual pipette sequentially as required. However, it is appropriate to have the stepped arrangement of the front wall so that individual packages of pipettes may be stacked in reverse order one, upon the other, in order to save space during shipment and subsequent storage.

Other modifications within the purview of this invention include the fact that upper portion of front wall 16 adjacent platform 38 may be hinged with a sealing tab to provide access to area 40. With that arrangement, lid 14 is a single piece joined to tray body 12, or formed as an integral piece with tray body 12.

While the form of apparatus herein described constitutes a preferred embodiment of the invention, it is to be understood that the invention is not limited to this precise form of apparatus, and the changes may be made therein without departing from the scope of the invention which is defined in the appended claims.

What is claimed is:

1. A storage and dispenser tray for pipettes, comprising (a) a self-standing elongated dispenser tray body;

(b) said body having a front wall, a rear wall, spaced apart end walls and a base wall;

(c) said front wall being stepped to provide a pipette dispensing platform extending from one end wall to the other end wall;

(d) a plurality of spaced apart integral insert portions in said front wall adjacent said base wall;

(e) the internal surface of each of said plurality of insert portions extending into said storage compartment and defining a curved feeding surface for pipettes;

(f) said curved feeding surface of each of said plurality of insert portions extending from said base wall to said dispensing platform;

(g) an elongated lid for said tray body;

(h) means for opening a portion of said lid to gain access to a pipette on said dispensing platform; and (i) said self-standing elongated dispenser tray body movable from a first storage position in which said tray is self-standing on said base wall to a second position in which said tray is in a tilted dispensing position and self-standing on said base wall and said front wall.

2. The storage and dispenser tray of claim 1, further comprising:

(a) cooperating sealing surfaces on said tray and lid for joining said tray and lid together.

3. The storage and dispenser tray of claim 2, further comprising (a) an elongated peel tab extending along the length of said lid from one end wall to the other and forming a portion of said lid;

(b) said peel tab positioned on said lid adjacent said dispensing platform;

(c) a hinge extending along the length of said lid;

(d) said peel tab movable around said hinge from a closed position to an open position; and (e) a portion of said cooperating sealing surface on said lid being positioned on said peel tab.

4. The assembly of claim 1, further comprising (a) said storage and dispenser tray being transparent.

5. A self-standing storage and dispenser tray for pipettes, comprising (a) an elongated dispenser tray body;

(b) said body having a front wall, a rear wall, spaced apart end walls and a base wall;

(c) said front wall being stepped to provide a pipette dispensing platform extending from one end wall to the other end wall;

(d) a curved feeding surface portion in said front wall;

(e) said curved feeding surface portion extending from said base wall to said dispensing platform;

(f) an elongated lid for said tray body;

(g) means for opening a portion of said lid to gain access to a pipette on said dispensing platform; and (h) said self-standing elongated dispenser tray body movable from a first storage position in which said tray is self-standing on said base wall to a second position in which said tray is in a tilted dispensing position and self-standing on said base wall and said front wall.

6. The storage and dispenser tray of claim 5, further comprising (a) cooperating sealing surfaces on said tray and lid for joining said tray and lid together.

7. The storage and dispenser tray of claim 6, further comprising (a) an elongated peel tab extending along the length of said lid from one end wall to the other and forming a portion of said lid;

(b) said peel tab positioned on said lid adjacent said dispensing platform;

(c) a hinge extending along the length of said lid;

(d) said peel tab movable around said hinge from a closed position to an open position; and (e) a portion of said cooperating sealing surfaces on said lid being positioned on said peel tab.

8. The assembly of claim 5, further comprising (a) said storage and dispenser tray being transparent.

* * * * *